US005384919A

United States Patent [19]

Smith

[11] Patent Number: 5,384,919

[45] Date of Patent: Jan. 31, 1995

[54] TOILET SEAT SUPPORTED BIDET

[76] Inventor: W. Fred Smith, 2048 Sage, Corona, Calif. 91720

[21] Appl. No.: 167,133

[22] Filed: Dec. 16, 1993

[51] Int. Cl.[6] ..... A61H 35/00

[52] U.S. Cl. ..... 4/448; 4/420.2; 4/420.4; 251/238

[58] Field of Search ..... 4/420.01–420.5, 4/443–448; 251/238, 325, 242, 244

[56] References Cited

U.S. PATENT DOCUMENTS

| | | | |
|---|---|---|---|
| 1,940,932 | 12/1933 | Albertine | 251/238 |
| 3,570,015 | 3/1971 | Rosengaus | 4/420.4 |
| 4,041,533 | 8/1977 | Sussman | 4/447 |
| 4,068,325 | 1/1978 | Benthin | 4/420.4 |
| 4,197,594 | 4/1980 | Butterfield | 4/448 |
| 4,304,016 | 12/1981 | Oguma et al. | 4/443 |
| 4,406,025 | 9/1983 | Huck et al. | 4/420.4 |
| 4,537,182 | 8/1985 | Otani | 251/325 |
| 4,606,369 | 8/1986 | McKay | 251/238 |

*Primary Examiner*—Henry J. Recla
*Assistant Examiner*—Gregory M. Vidovich
*Attorney, Agent, or Firm*—Roy A. Ekstrand

[57] ABSTRACT

A conventional toilet includes a bowl having a bowl interior supported upon a base and having a rectangular flush tank supplied from a conventional water supply. The bowl portion supports a conventional toilet seat having a center hole and a hinged attachment to the seat support portion of the bowl. A toilet seat supported bidet includes an elongated nozzle pipe having an upwardly directed nozzle pivotally supported on the underside of the toilet seat such that the nozzle water flow extends upwardly through the hole in the toilet seat. A slide valve is coupled to the nozzle pipe and is operated by a pivotal handle. A supply of heated water is coupled to the slide valve from a source of water under pressure. A pair of friction clips secure the nozzle pipe to the undersurface of the toilet seat in a frictional pivotal attachment to facilitate the angular movement of the nozzle pipe to affect angular motion of the nozzle.

9 Claims, 2 Drawing Sheets

TOILET SEAT SUPPORTED BIDET

FIELD OF THE INVENTION

This invention relates generally to sanitary facilities such as toilets and particularly to the sanitary facility generally known as a bidet.

BACKGROUND OF THE INVENTION

In many situations, persons using toilet facilities have a desire or a need to utilize a sanitary device known generally as a bidet. The typical bidet facility provides a water receiving bowl or catch basin which is coupled to a waste water disposal system or bathroom drain. A water dispersing nozzle is supported within the bowl and is coupled to a source of warmed water under pressure. The nozzle is directed upwardly and positioned within the bowl to direct a stream of cleansing water against the underside of the user as the user is positioned over the bowl. The object in using a bidet is to cleanse the genital and anal skin areas on the underside of the user's torso.

The use of bidets within many European countries is well known and frequently employed. However, within the United States of America the use of bidets is relatively sparce and to a large extent unknown among Americans. One reason for the slow acceptance of bidets within the United States of America is the extensive standardization of toilet facilities throughout the country. Such standard toilet facilities do not include or facilitate the use of a bidet. In addition, the interior design style in most residences attempts to efficiently use the space allocated to the bathroom among several competing needs such as a shower or bathtub facility together with a bathroom sink and countertop and finally a toilet facility. As a result, those within the United States and elsewhere who desire or need to utilize a bidet are forced to undergo extensive bathroom remodeling and expense to install a conventional bidet.

There remains therefore a need in the art for a more cost effective and space efficient system for providing a bidet facility within a conventional bathroom.

SUMMARY OF THE INVENTION

Accordingly, it is a general object of the present invention to provide an improved bidet. It is a more particular object of the present invention to provide an improved bidet which may be conveniently used within an otherwise conventional bathroom facility without resorting to extensive alteration or remodeling of the facility.

In accordance with the present invention, there is provided for use in combination with a toilet having a toilet seat which defines a hole therethrough, an upper seating surface and an undersurface, a bidet comprises: a valve having an input for coupling to a supply of water under pressure, an output and a valve handle for opening and closing the valve; a nozzle pipe, a first end coupled to the valve output and a second end; an upwardly directed nozzle supported upon the second end of the nozzle pipe; and attachment means for securing the nozzle pipe to the toilet seat undersurface in a pivotal attachment whereby the nozzle pipe is rotationally positionable to adjust the angular position of the nozzle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
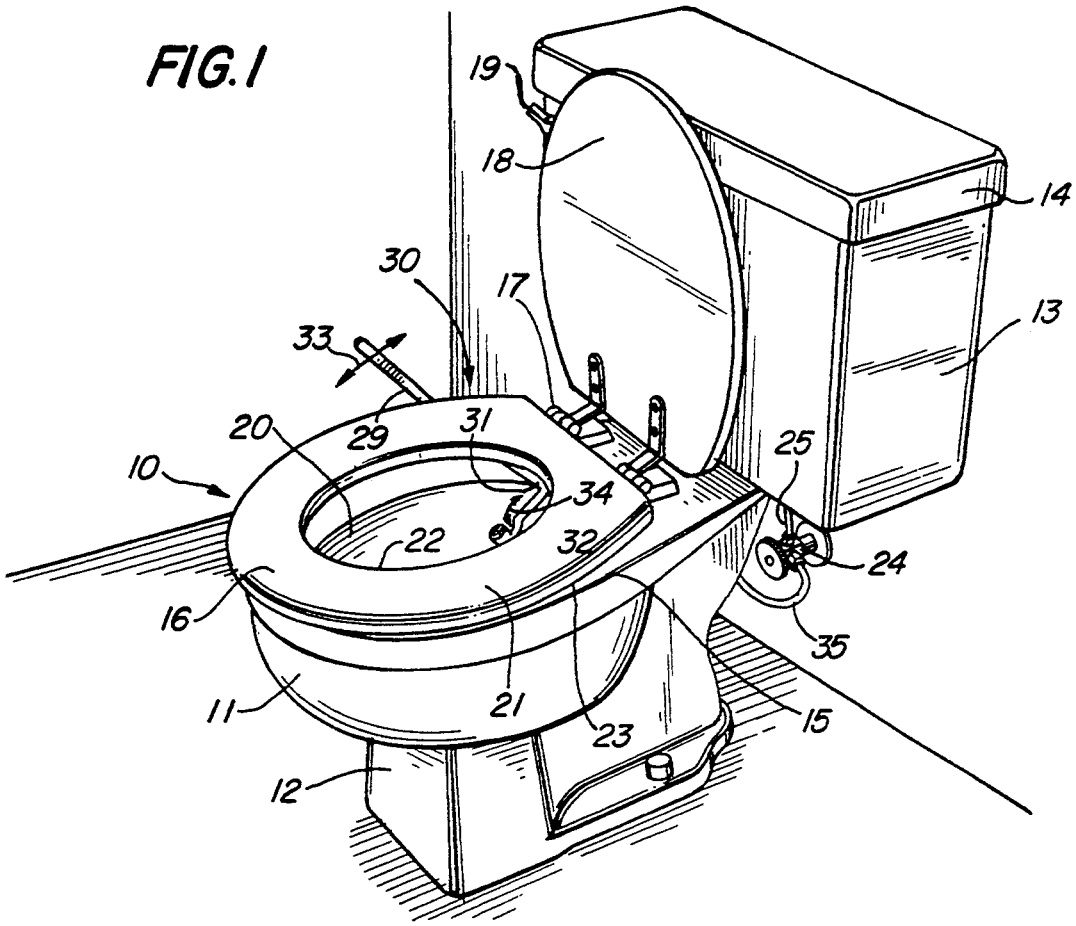
FIG. 1 sets forth a perspective view of a toilet facility having the present invention toilet seat supported bidet installed therein.

FIG. 1 sets forth a perspective view of a conventional toilet generally referenced by numeral 10 having a toilet seat supported bidet constructed in accordance with the present invention and generally referenced by numeral 30. Toilet 10 is constructed in accordance with conventional fabrication techniques and includes a bowl portion 11 supported upon a base 12 and defining a seat support 15. Toilet 10 further includes a generally rectangular flush tank 13 having a tank cover 14 secured thereto and supported by a flush handle 19. A supply valve 24 is coupled to a source of pressurized water (not shown) in accordance with conventional fabrication techniques. Supply valve 24 is coupled to a supply tube 25 which in further accordance with conventional fabrication techniques is coupled to the water level control valve within flush tank 13 (not shown). Bowl 11 further defines a bowl interior 20 having a drain at the lower portion thereof (not shown) which is coupled to a waste water drain or bathroom drain line. Toilet 10 further includes a toilet seat 16 having a seating surface 21 and an undersurface 23. Toilet seat 16 further defines a hole 22 extending therethrough. A hinge 17 pivotally secures toilet seat 16 to seat support 15 while a seat cover 18 is similarly secured by a pair of hinges 17. Thus, toilet 10 is constructed in accordance with conventional fabrication techniques and, but for the installation of the present invention bidet, is entirely conventional.

Figure 2:
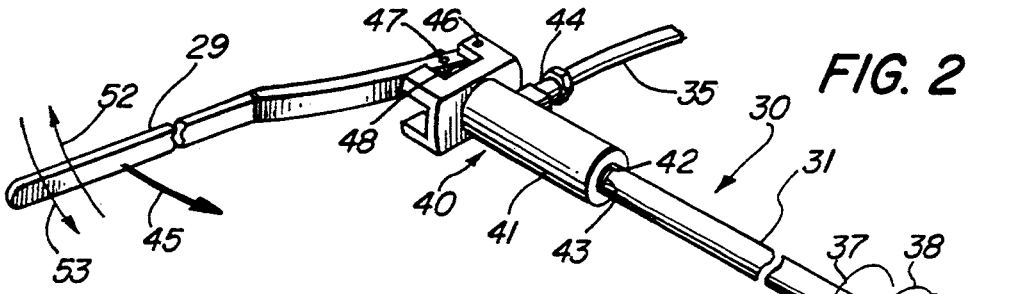
FIG. 2 sets forth a perspective view of the nozzle and valve portion of the present invention toilet seat supported bidet.
Figure 3:
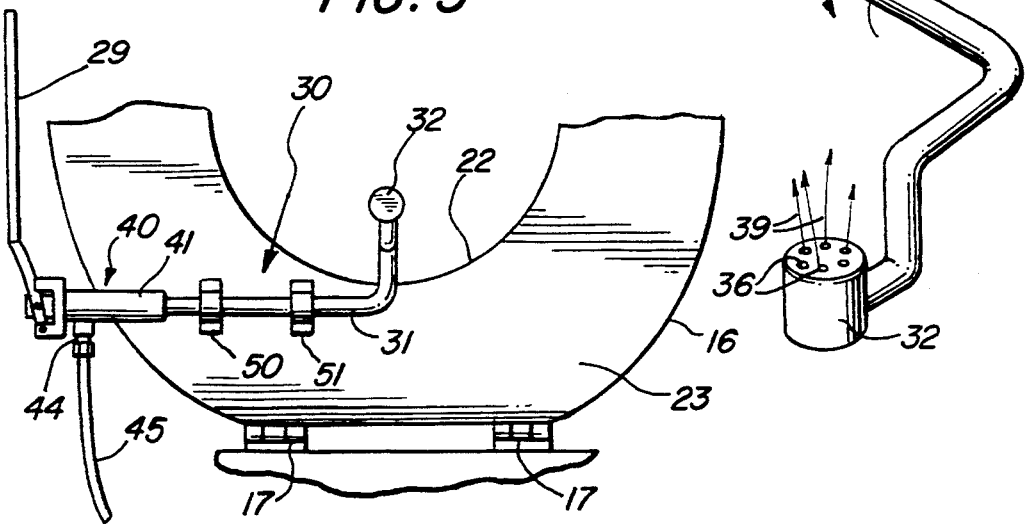
FIG. 3 sets forth a partial view of a toilet seat supported bidet secured to a conventional toilet seat and constructed in accordance with the present invention.

In accordance with the present invention, bidet 30 includes a nozzle pipe 31 extending beneath toilet seat 16 and secured to undersurface 23 thereof in the manner shown in FIG. 3. The interior end of nozzle pipe 31 supports an upwardly directed water nozzle 32. As is better seen in FIG. 2, the remaining end of nozzle pipe 31 passes beneath toilet seat 16 and is coupled to a valve 40 which in turn supports a water flow control handle 29. A supply tube 35 is coupled to supply valve 24 and valve 40 to provide a source of water under pressure. As is better seen in FIG. 6, supply tube 35 preferably passes through a water heater 60 constructed in accordance with conventional fabrication techniques which provides a partial warming of the water coupled from supply valve 24 to nozzle 32.

In operation, the user initially seats his or herself upon toilet seat 16 in the typical manner in which toilet 10 is used such that the genital and anal areas of the user are positioned above hole 22 in toilet seat 16. Thereafter, the user is able is carry forward the typical toilet facility activities afterwhich the user may employ bidet 30 to provide additional cleansing of the user's undersurface. The operation of bidet 30 is set forth below in greater detail. However, suffice it to note here that the user is able to pivot handle 29 in the directions indicated by arrows 33 to provide a corresponding pivotal motion of nozzle 32 in the directions indicated by arrows 34. In addition, the user having properly positioned nozzle 32 is able to control an upwardly directed stream of water emanating from nozzle 32 against the user's undersurface by urging handle 29 inwardly toward toilet seat 16. The user maintains the inward position of handle 29 for the desired cleansing time afterwhich the user simply releases handle 29 allowing the return spring apparatus within bidet 30 set forth in FIGS. 4 and 5 to return handle 29 outwardly and terminate the water flow from nozzle 32.

In accordance with an important aspect of the present invention, bidet 30 is installed within toilet 10 in a simple straight forward installation in which little or no modification of toilet 10 is required. In further accordance with an important aspect of the present invention, the installation of bidet 30 permits the user to direct nozzle 32 through a wide angular adjustment to direct the water stream from nozzle 32 to the desired portion of the user's underside body. It will be further apparent to those skilled in the art that the present invention bidet requires no additional space and may be removed from toilet 10 easily and thereby restore toilet 10 to its original condition.

FIG. 2 sets forth a perspective view of the water control portion of bidet 30. Bidet 30 includes a water flow control valve 40 having a cylindrical body 41 and defining a threaded aperture 42. Valve body 41 further includes an input fitting 44 coupled to supply tube 35 by conventional fabrication techniques. A nozzle pipe 31 defines an elongated multiply curved circular cross-section member having a threaded end 43 which is threadably received within threaded aperture 42 of valve body 41. The remaining end of nozzle pipe 31 is multiply curved through a stair step configuration and supports a nozzle 32. Nozzle 32 defines a plurality of nozzle apertures 36 on the upper surface thereof.

A handle 29 is pivotally secured to valve body 41 by a pin 46. A valve slide 48 (better seen in FIGS. 4 and 5) is slidably received within valve body 41 and is pivotally coupled to handle 29 by a pin 47.

In operation, bidet 30 is secured to the undersurface 23 of toilet seat 16 in the manner shown in FIG. 3 and is operatively coupled by supply tube 35 to a source of pressurized water by supply tube 35. As is better seen in FIG. 6, the coupling of supply tube 35 to supply valve 24 preferably includes an in-line water heater 60. Returning to FIG. 2, handle 29 is spring biased to its outwardly angled position by a return spring within valve body 41 (seen in FIG. 4). In the relaxed position, valve 40 is closed and the water flow coupling from supply tube 35 to nozzle 32 via nozzle pipe 31 is interrupted. As the user forces handle 29 inwardly in the direction indicated by arrow 45, however, valve slide 48 is moved correspondingly and a water flow path is opened within body 41 into nozzle pipe 31. The flow of pressurized water within nozzle pipe 31 produces an upwardly directed water stream through apertures 36 in the upper surface of nozzle 32. The water flow indicated by arrows 39 continues so long as the user maintains the inward position of handle 29. It should be noted that in accordance with the operation of valve 40 set forth below in greater detail, the water flow through bidet 30 is operatively controlled to produce the desired water flow level or force by controlling the position of handle 29. Once the user releases handle 29, valve 40 again closes and the flow of water is terminated.

In accordance with a further advantage of the present invention and as is better seen in FIG. 3, bidet 30 is pivotally supported against the undersurface of toilet seat 16 by a pair of clips 50 and 51. As a result, the rotational position of bidet 30 may be adjusted by the user by simply pivoting handle 29 in the upward direction indicated by arrow 52 or the downward direction indicated by arrow 53. The pivotal motion of handle 29 upwardly in the direction indicated by arrow 52 causes a corresponding rotational motion of nozzle pipe 31 in the direction indicated by arrow 38 which in turn increases the vertical angle of the directed water stream from nozzle 32. Conversely, the downward pivotal motion of handle 29 in the direction indicated by arrow 53 causes a rotational motion of nozzle pipe 31 in the direction indicated by arrow 37 thereby decreasing the vertical angle of the water spray produced by nozzle 32. In this manner, the area of the user's underside which is bathed in the water stream emanating from nozzle 32 may be controlled and the water stream may be directed forwardly to cleanse the genital portions of the user's body or directed more vertically to cleanse the anal portions of the user's undersurface.

FIG. 3 sets forth a bottom view of the present invention bidet secured to toilet seat 16. As described above, toilet seat 16 defines a hole 22 and an undersurface 23. As is also described above, toilet seat 16 is pivotally secured to seat support 15 by a pair of hinges 17. A pair of clips 50 and 51 defining center apertures therethrough are secured to undersurface 23 using conventional fabrication techniques. Clips 50 and 51 may be constructed in accordance with well known fabrication techniques and may, for example, comprise molded plastic or nylon clip members having center apertures generally corresponding and slightly smaller than the outer diameter of nozzle pipe 31 of bidet 30. Alternatively, clips 50 and 51 may comprise spring loaded or resilient clips having a general "C-shaped" configuration which permits nozzle pipe 31 to be snap-fitted within clips 50 and 51 to provide a secure attachment while facilitating the pivotal adjustment of bidet 30 described above. In any event, bidet 30 includes a valve 40 having a valve body 41 defining an input fitting 44 coupled to a supply tube 45. Bidet 30 further includes a handle 29 coupled to valve 40 for operation of valve 40 in the manner described below in FIGS. 4 and 5. A nozzle pipe 31 is received within clips 50 and 51 in a secure pivotal attachment and extends into valve body 41. The remaining end of nozzle pipe 31 supports nozzle 32 within hole 22 of toilet seat 16 in the manner set forth above.

It will be apparent to those skilled in the art that the attachment of clips 50 and 51 to undersurface 23 of toilet seat 16 is, in essence, the sole modification to toilet 10 required for installation of the present invention bidet. Thus, it will be apparent to those skilled in the art that little or no additional remodeling or cost is associated with the installation of the present invention bidet.

Figure 4:
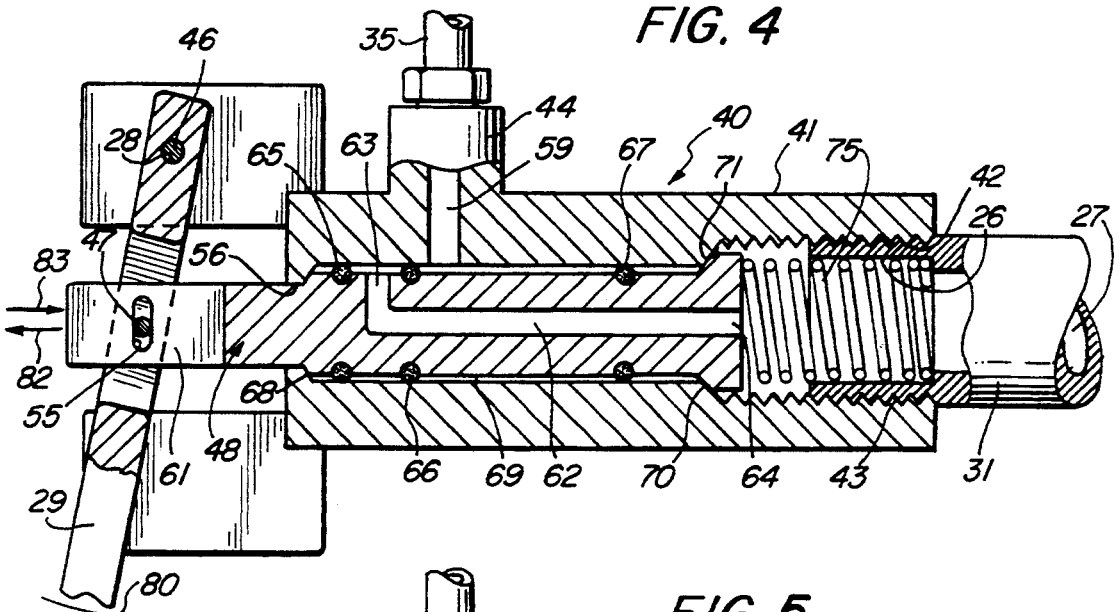
FIGS. 4 and 5 set forth section views of the valve portion of the present invention bidet in the closed and open positions respectively.
Figure 5:
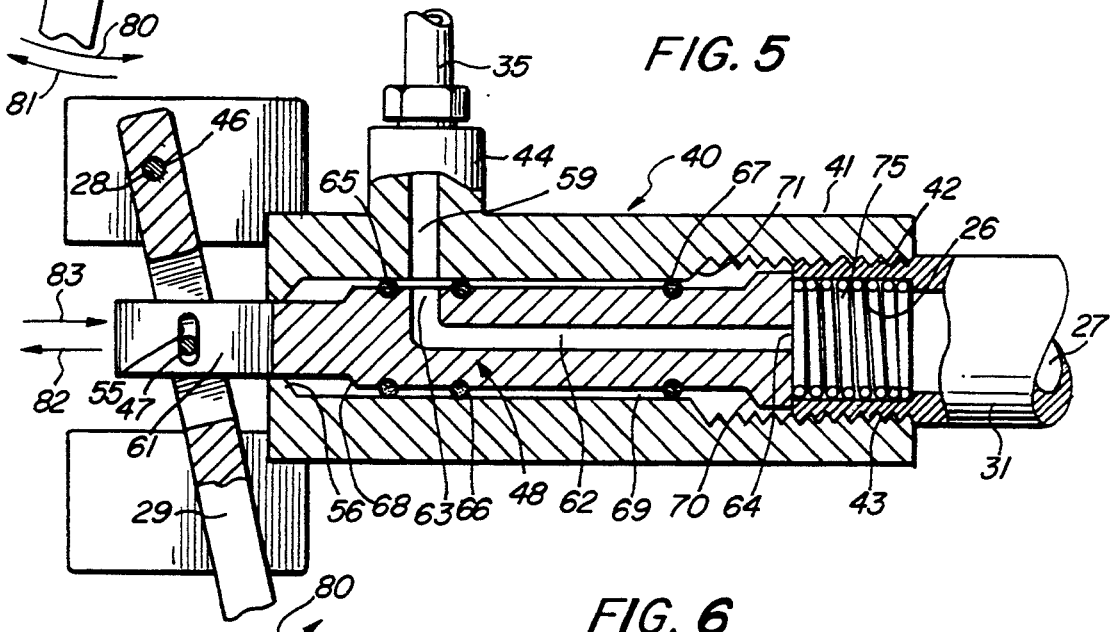

FIGS. 4 and 5 set forth section views of valve 40 operative within the present invention bidet. FIG. 4 sets forth valve 40 in the closed position while FIG. 5 sets forth valve 40 in the open position.

More specifically and with reference to FIG. 4, valve 40 includes a valve body 41 defining a generally cylindrical elongated body having a threaded aperture 42 formed at one end thereof. Valve body 41 further defines an elongated slider passage 69 extending inwardly from threaded aperture 42 and a tapered portion 70 extending therebetween. Slider passage 69 terminates in an inwardly extending constriction 56 at the opposite end from threaded aperture 42. Valve body 41 further defines an input fitting 44 having a passage 59 extending therethrough. Fitting 44 is coupled to supply tube 35 in a conventional attachment. A nozzle pipe 31 includes a threaded end 43 threadably received within aperture 42 to engage valve body 41. Nozzle pipe 31 further defines a recess 26 at the interior end thereof which receives a coil return spring 75.

Valve 40 further includes a movable valve slide 48 having an elongated generally cylindrical shape and defining a tapered portion 70 at the interior end thereof. Valve slide 48 further defines an aperture 64 and a generally L-shaped passage 62 extending inwardly therefrom. Passage 62 terminates in an aperture 63. Valve slide 48 further includes a tab 61 extending outwardly from valve body 41 and coupled to the remainder of valve slide 48 by a tapered portion 68. Tab 61 further defines a slot 55 which receives a pin 47 extending from handle 29. Pin 47 is movable within slot 55 to provide a pivotal engagement between handle 29 and tab 61 of valve slide 48. Slot 55 facilitates the compensating motion of pin 47 with respect to tab 61 as handle 29 is pivotally moved. Handle 29 further defines an aperture 28 receiving a pin 46 which provides pivotal attachment of the end portion of handle 29 to valve body 41. Thus, handle 29 is pivotally movable in a motion centered about pin 46 in the directions indicated by arrows 80 and 81.

Valve slide 48 further includes a plurality of O-ring seals 65, 66 and 67 positioned within slider passage 69 in the manner shown. Of importance to note is the position of O-rings 65 and 66 on either side of aperture 83. O-rings 65, 66 and 67 provide a continuous seal between valve slide 48 and the interior of slider passage 69. Thus, the sole coupling path available between passage 59 of input fitting 44 and passage 27 of nozzle pipe 31 is provided through apertures 63 and 64 and passage 62. Coil spring 75 is captivated within recess 26 and tapered portion 70 of valve slide 48 to provide a spring force exerted against valve slide 48 urging valve slide 48 in the direction indicated by arrow 82. Constriction 56 and taper 68 together with taper 70 and constriction 71 cooperate to limit the travel of valve slide 48 in the direction of arrow 82 to the position shown in FIG. 4.

Thus, in the position shown in FIG. 4 and in the absence of a pivotal force upon handle 29, spring 75 forces valve slide 48 in the direction of arrow 82 moving aperture 63 and O-rings 65 and 66 beyond passage 59. O-ring 67 completes the closure of valve 40 by providing a water tight seal between valve slide 48 and slider passage 69. Thus, water under pressure entering supply tube 35 and passage 59 of input fitting 44 is precluded from further flow by O-rings 66 and 67. Thus, in the position shown in FIG. 4, valve 40 is closed and water flow through valve 40 into nozzle pipe 31 is prevented.

FIG. 5 sets forth the position of valve 40 corresponding to the open position in which handle 29 is pivoted in the direction indicated by arrow 80. As handle 29 is forced inwardly overcoming the force of spring 75, handle 29 pivots about pin 46 in the direction indicated by arrow 80. Correspondingly, the coupling between handle 29 and tab 61 provided by pin 47 and slot 55 causes valve slide 48 to move inwardly in the direction indicated by arrow 83 as return spring 75 is compressed. In the position shown in FIG. 5, valve 40 is in the fully open position characterized by the alignment between aperture 63 of passage 62 and passage 59 of input fitting 44. Thus, in the fully open position shown in FIG. 5, O-rings 65 and 66 provide a water tight seal on either side of aperture 63 and thus the water under pressure provided by supply tube 35 flows through passage 59, aperture 63 and into passage 62. Thereafter, the water under pressure continues to flow outwardly from aperture 64 through passage 27 of nozzle pipe 31 to produce the above-described water flow from nozzle 32 (seen in FIG. 2).

It will be apparent from examination of FIGS. 4 and 5 together, that while FIG. 4 shows the fully closed position of valve 40 and FIG. 5 shows the fully open position of valve 40, a continuous adjustment of water flow is facilitated by valve 40 by intermediate positions of handle 29 and valve slide 48. In essence, as handle 29 is moved inwardly in the direction of arrow 80, water flow commences as O-ring 66 is brought into proximity of passage 59. Once O-ring 66 passes the first edge of passage 59, a quantity of water is then able to flow past O-ring 66 and into aperture 63 to provide a flow outwardly through nozzle pipe 31. The degree of flow is thereafter increased as handle 29 is moved further inward in the direction indicated by arrow 80 to produce a greater flow area as O-ring 66 moves across the end portion of passage 59.

Figure 6:
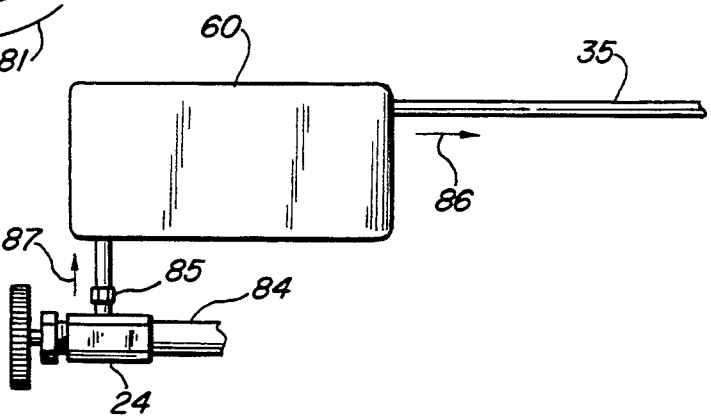
FIG. 6 sets forth a partial view of the heater installation within the present invention toilet seat supported bidet.

FIG. 6 sets forth the installation of an in-line water heater generally referenced by numeral 60 to provide heating of the water flow through the present invention bidet. Thus, a supply valve 24 constructed in accordance with conventional fabrication techniques is coupled to a conventional water supply pipe 84. Supply valve 24 includes a fitting 85 coupled to supply tube 35. As described above, supply tube 35 is coupled to input fitting 44 of valve 40. Water heater 60 is constructed in accordance with conventional fabrication techniques and in its preferred form comprises an electrically powered in-line water heater which is interposed within supply tube 35 at a convenient place for physical support of water heater 60.

In operation with supply valve 24 open, water flows through fitting 85 in the direction indicated by arrow 87 passing through water heater 60 to be heated therein by electrical heating apparatus of conventional construction and thereafter to flow outwardly from heater 60 in the direction indicated by arrow 86. It will be apparent to those skilled in the art that a variety of other apparatus may be utilized to provide a warming of the water flow within supply tube 35 to suit the user's preference for water temperature in the above-described cleansing process. For example, it may be opportune in some systems to utilize a supply valve which is operative in combination with a supply of heated water from the hot water supply of the bathroom facility and to mix the hot water rather than utilize an in-line water heater. Similarly, other water heaters beyond the in-line electric heater shown in FIG. 6 may be utilized without departing from the spirit and scope of the present invention.

What has been shown is a low cost, convenient, easy to install toilet seat supported bidet which requires little or no modification of the existing conventional toilet facility. The system shown provides flexibility of operation in that the bidet may be pivoted to direct the cleansing water spray to the desired portion of the user's anatomy by simple manipulation of the water flow handle. The operation of the present system is provided by a single handle in which the user is able to readily understand that pivotal motion of the handle in the vertical direction changes the spray angle while pivotal motion of the handle inwardly in the horizontal direction provides control of the water flow. The system is portable in the sense that it may readily be removed from an existing installation and installed in a subsequent toilet facility. In addition, it will be apparent to those skilled in the art that the system is sufficiently portable to facilitate the transport of the bidet by the user between various temporary residential facilities.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a toilet having a toilet seat which in its lowered position lies in a generally horizontal plane and which toilet seat defines a hole therethrough, an upper seating surface and an undersurface, a bidet comprising:

a valve having a valve body, an input for coupling to a supply of water under pressure, an output and an elongated valve handle having a first end pivotally coupled to said body and a second end for opening and closing said valve in response to pivotal motion of said handle in a first direction generally parallel to said horizontal plane of said toilet seat;

a nozzle pipe having a first end coupled to said valve output and a second end;

a nozzle supported upon said second end of said nozzle pipe; and attachment means for securing said nozzle pipe to said toilet seat undersurface in a pivotal attachment whereby said nozzle is directed upwardly toward said hole in said toilet seat and said valve handle is accessible to a user seated upon said toilet seat and said valve body and said nozzle pipe are rotationally positionable to adjust the angular position of said nozzle with respect to the plane of said toilet seat by pivoting said valve handle in a second direction within a plane generally orthogonal to said horizontal plane of said toilet seat.

2. A bidet as set forth in claim 1 wherein said nozzle pipe defines a curved portion proximate said second end for supporting said nozzle below said undersurface.

3. A bidet as set forth in claim 2 wherein said valve further includes:

an elongated slider passage extending through said valve body and an input passage coupled to said input;

a valve slide slidably received within said slider passage and defining a coupling passage therethrough; and a return spring urging said valve slide in said first direction within said slider passage, said valve slide movable in said first direction to a closed position in which said coupling passage is removed from said input passage and movable in an opposite direction opposite from said first direction to an open position in which said coupling passage is at least partially aligned with said input passage.

4. A bidet as set forth in claim 3 wherein said attachment means includes a plurality of clips secured to said toilet seat undersurface and receiving said nozzle pipe.

5. A bidet as set forth in claim 4 further including a water heater coupled between said valve input and a supply of water under pressure.

6. A bidet as set forth in claim 5 wherein said valve body extends outwardly beyond the toilet seat of the toilet and wherein said handle is attached to an outer portion of said valve body.

7. A bidet as set forth in claim 1 wherein said valve further includes:

an elongated slider passage extending through said valve body and an input passage coupled to said input;

a valve slide slidably received within said slider passage and defining a coupling passage therethrough; and a return spring urging said valve slide in said first direction within said slider passage, said valve slide movable in said first direction to a closed position in which said coupling passage is removed from said input passage and movable in an opposite direction opposite from said first direction to an open position in which said coupling passage is at least partially aligned with said input passage.

8. A bidet as set forth in claim 7 wherein said valve handle is pivotally coupled to said valve slide.

9. A bidet as set forth in claim 1 further including a water heater adapted to be coupled between said valve input and a supply of water under pressure.

* * * * *